United States Patent [19]

Berti

[11] Patent Number: 5,010,616

[45] Date of Patent: Apr. 30, 1991

[54] SLANTED HANDLE BROOM

[75] Inventor: Enzo Berti, Mirano, Italy

[73] Assignee: The Libman Company, Arcola, Ill.

[21] Appl. No.: 441,478

[22] Filed: Nov. 27, 1989

[51] Int. Cl.[5] ..... A46B 9/02

[52] U.S. Cl. ..... 15/159 R; 15/143 R; 15/145; 15/168; 15/171; 15/176.3

[58] Field of Search ..... 15/143 R, 145, 159 R, 15/168, 169, 171, 191 R, 192, 146, 244.1, 229.2, 176.3

[56] References Cited

U.S. PATENT DOCUMENTS

| | | | |
|---|---|---|---|
| 107,559 | 9/1870 | Strong | 15/145 |
| 1,457,414 | 6/1923 | Adams | 15/171 |
| 1,761,101 | 6/1930 | Blood | 15/159 R |
| 2,215,610 | 9/1940 | Goldrick et al. | 15/171 |
| 2,262,961 | 11/1941 | Otto | 15/159 R |
| 3,340,556 | 9/1967 | Allen | 15/159 R |
| 4,157,598 | 6/1979 | Talent et al. | 15/145 |
| 4,385,411 | 5/1983 | Clark | 15/171 |
| 4,541,139 | 9/1985 | Jones et al. | 15/171 |
| 4,642,837 | 2/1987 | Nichols et al. | 15/171 |

FOREIGN PATENT DOCUMENTS

| | | | |
|---|---|---|---|
| 212543 | 8/1956 | Australia | 15/159 R |
| 160623 | 11/1985 | European Pat. Off. | 15/159 R |
| 182569 | 3/1907 | Fed. Rep. of Germany | 15/143 R |
| 945001 | 11/1948 | France | 15/171 |
| 59549 | 7/1938 | Norway | 15/146 |

*Primary Examiner*—Harvey C. Hornsby
*Assistant Examiner*—Mark Spisich
*Attorney, Agent, or Firm*—Marshall, O'Toole, Gerstein, Murray & Bicknell

[57] ABSTRACT

A broom comprising an elongated block with opposing side walls and end walls, a top and, when viewed in side elevation, having a curved bottom; the block bottom having a plurality of spaced apart holes having about the same depth and containing the upper ends of tufts of broom fibers; all the broom fibers in all the tufts in the holes having essentially the same length whereby the curved block bottom and the fanning effect of the fibers after being embedded in the holes creates a broom sweeping head of fibers with a straight outer end without a need to cut the outer ends of the fibers after being embedded in the holes; the lower end of a broom handle being connected to the block at an angle of at least about 5° from vertical when measured with the lower end of the broom sweeping head resting on a horizontal surface and with the broom handle axis intersecting the block top at a location, when measured from one end of the block, which is about 30 to 45% of the length of the block.

22 Claims, 2 Drawing Sheets

76
64
50
72
24
32
40
56
74
34
72
26
36

3.
74
76
72
50
74
3.
74
2.

5°
56
76
72
74
74
74
70
40
2.

SLANTED HANDLE BROOM

This invention relates to brooms. More particularly, this invention relates to brooms which are easily manufactured, minimize broom fiber waste and which are adapted for sweeping partially obscured floor areas, such as the toe spaces below counter tops and kitchen cabinets.

BACKGROUND OF THE INVENTION

Brooms are extensively used for sweeping surfaces of many types and at many locations. The most common brooms have a straight handle connected at its lower end to a broom head containing a mass of natural or synthetic fibers generally arranged to form opposing spaced apart sides which fan out slightly and terminate in a bottom end which is essentially straight. While such a broom has many uses it is not well adapted to sweep the toe-receiving floor space beneath counter tops and kitchen cabinets.

A commercially available broom adapted to sweep partially obscured floor space has the broom end cut at a slant of about 15° so that the fibers at one end are about three inches or so longer than at the other end. The broom handle, however, is positioned perpendicular to the body to which the fibers are secured. The shape of the broom head thus requires that the end having the longest fibers be used to sweep the toe floor space which, however, has a clearance lower than the height of the broom head portion to be directed into that space. This requires the sweeper to rotate the handle downwardly so that the side face of the broom head is angled to the floor rather than held approximately upright as desired for sweeping.

Another disadvantage of such a broom is that it is not readily feasible to manufacture a broom with the fibers inserted initially of different but progressively increasing lengths to produce the slanted broom head end with a straight edge. As a result, longer fibers than required in the finished broom are used, making it necessary to trim the fibers to the desired slanted end. This causes waste of fiber and an extra step.

It is also recognized that the broom fibers should all be about the same length so that the desired flexibility is obtained for good sweeping effectiveness. When the fibers are too short there is a stiffness which adversely effects dirt movement and when the fibers are too long the broom head becomes misshapen readily with the mass of fibers curved outwardly to one side. In general, for particular fibers, depending on their nature, chemical composition and diameter, there is an optimum length for best sweeping when used in a broom head. For this reason the broom head should contain fibers of about the same length or within a narrow range length.

SUMMARY OF THE INVENTION

According to a first major aspect of the invention a broom is provided having an elongated block with opposing side walls, end walls, a top and a bottom; the block bottom having a plurality of spaced apart holes containing the upper ends of tufts of broom fibers; the lower end of a broom handle being connected to the block at an angle of at least about 5°, and desirably about 5 to 15°, from vertical when measured with the block in a substantially level position. When the block is in substantially level position the lower end of the broom sweeping head formed by the ends of the broom fibers desirably is substantially horizontal. Such a broom has excellent sweeping characteristics and can be used to sweep obscured floor areas, such as the floor toe spaces beneath counters and kitchen cabinets.

The lower end of the broom handle can be connected to the block top. The block top can include an upwardly projecting member containing a handle-receiving hole and the lower end of the broom handle can be secured in the handle-receiving hole. The handle-receiving hole in the upwardly projecting member can be slanted to essentially the same angle as the handle.

While the broom handle lower end can be connected to the block top center or slightly off-center, it is desirable to connect the handle to the block top such that the broom handle axis intersects the block top at a location, when measured from one end of the block, which is about 30 to 45% of the length of the block.

The block top can include an upwardly projecting member containing a handle-receiving hole and the lower end of the broom handle can be secured in the handle-receiving hole. The handle-receiving hole in the upwardly projecting member can be slanted to essentially the same angle as the handle.

The broom can include a broom cap which fits over the block and has a opening through which the handle extends. The broom cap can include a skirt portion adapted to cover the block side walls and ends in nesting arrangement therewith, a shoulder portion closing and joined to the upper end of the skirt portion and a neck portion extending upwardly from the shoulder portion top and having a hole at the top through which the broom handle extends. The neck portion of the broom cap can be positioned such that the axis of the broom handle extends through the hole in the neck portion and intersects the block top at a location, when measured from one end of the block, which is about 30 to 45% of the length of the block.

According to a second major aspect of the invention a broom is provided having an elongated block with opposing side walls and end walls, a top and, when viewed in side elevation, having a curved bottom; the block bottom having a plurality of spaced apart holes having about the same depth and containing the upper ends of tufts of broom fibers; all the broom fibers in all the tufts in the holes having essentially the same length whereby the curved block bottom and the fanning effect of the fibers after being embedded in the holes creating a broom sweeping head of fibers with a straight outer end without a need to cut the outer ends of the fibers after being embedded in the holes; and the lower end of a broom handle being connected to the block.

The broom handle can be connected perpendicular to the block top or it can be slanted thereto, such as at an angle of about at least 5° with the block essentially level and/or with the lower end of the broom sweeping head resting on a horizontal surface. When slanted a straight handle is desirably about 5 to 15° from vertical.

Although the lower end of the broom handle can be connected to the center, or slightly off-center, of the block, it is also suitable for the lower end of the broom handle to be connected to the block such that the broom handle axis intersects the block top at a location, when measured from one end of the block, which is about 30 to 45% of the length of the block.

The broom constituting this second aspect of the invention can also include a broom cap as described above in connection with the broom constituting the first aspect of the invention. Additionally, the other features of the block described above in regard to the broom of the first aspect of the invention are also applicable to the broom of the second aspect of the invention.

DETAILED DESCRIPTION OF THE DRAWINGS

To the extent it is reasonable and practical the same or similar elements which appear in the various views of the drawings will be identified by the same numbers.

Figures 1, 2, 4:
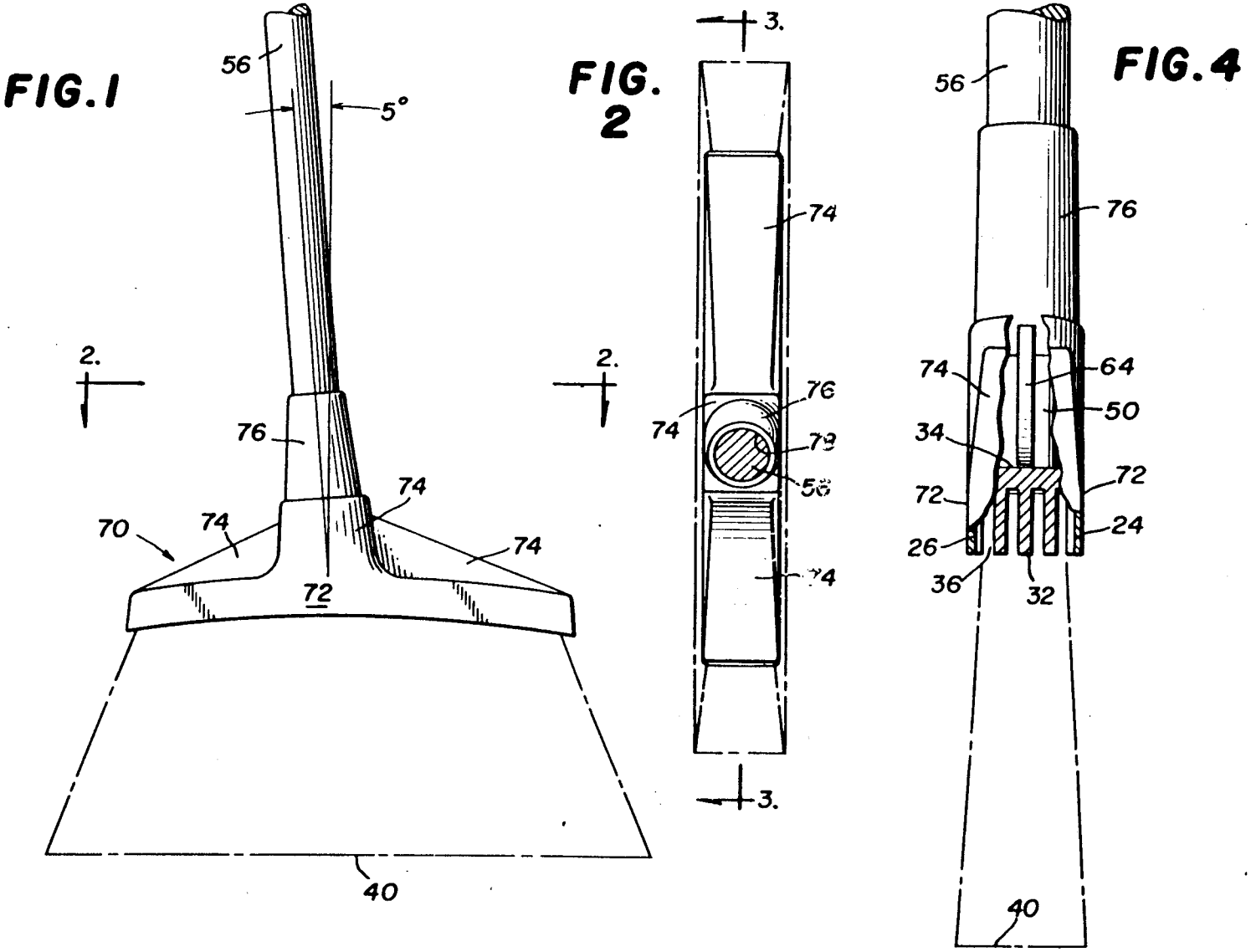
FIG. 1 is a side elevational view of a broom provided by the invention.
FIG. 2 is a top view of the broom shown in FIG. 1 taken along the line 2—2.
FIG. 4 is a sectional view taken along the line 4—4 of FIG. 3.
Figure 3:
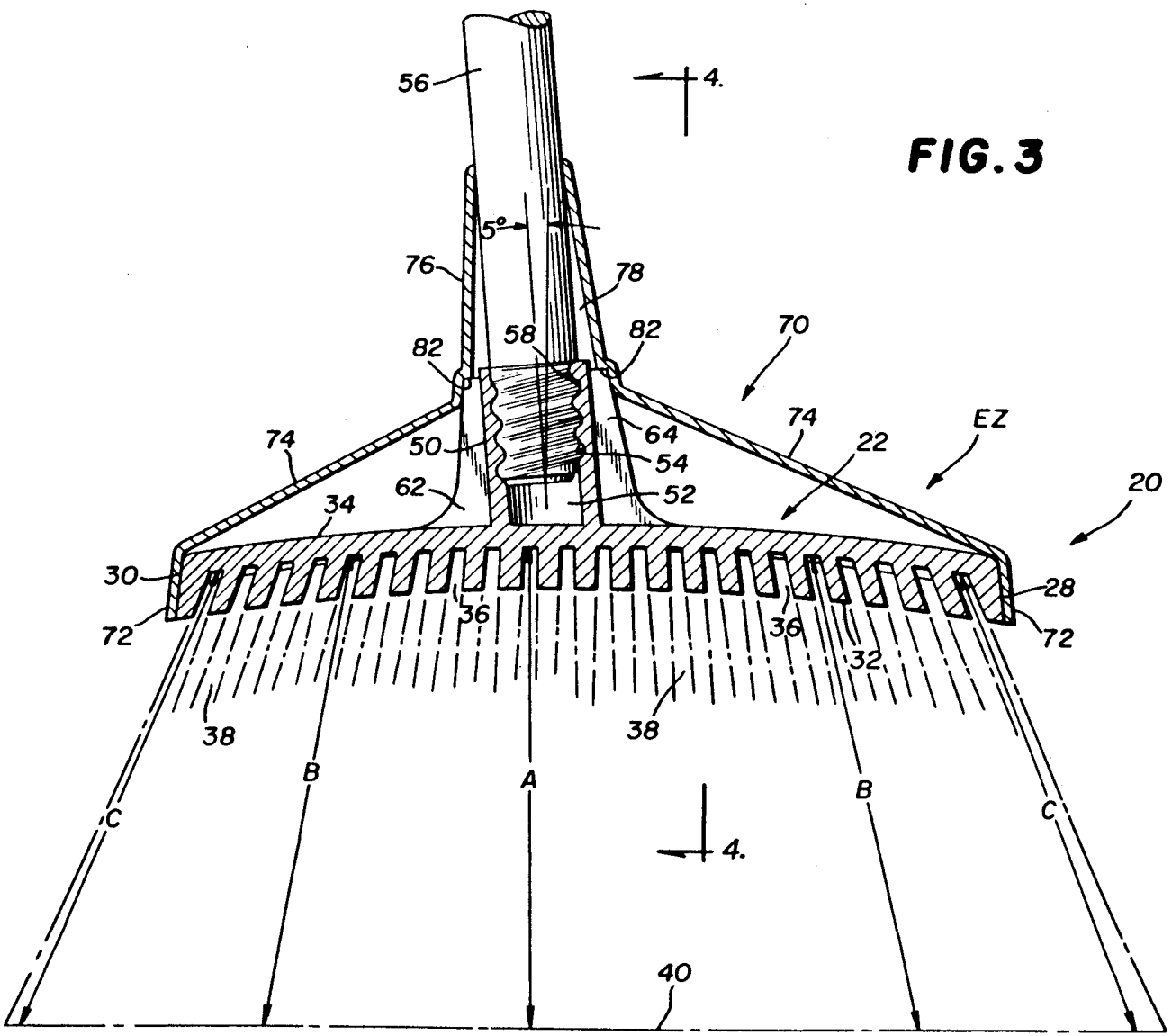
FIG. 3 is a partial sectional view taken along the line 3—3 of FIG. 2.

Referring first to FIGS. 3 and 4 the broom 20 includes an elongated block 22 having a pair of opposing side walls 24, 26, end walls 28, 30, a bottom 32 and a top 34. The block 22 has four side-by-side parallel rows of equally spaced apart circular holes 36 which project inwardly of the block from the bottom 32 for a uniform depth or identical distance. The number of holes in adjacent rows will usually differ by one hole and the holes are located such that holes in adjacent rows are staggered laterally in a zig-zag pattern.

Tufts 38 of broom fibers, which may be natural or synthetic fibers, are forced into the holes 36. The bottom 32 of block 22 can be straight and flat. However, when the upper ends of tufts of fibers of the same length are inserted into the holes 36 in a straight flat bottom 32 the lower ends of the fibers apply lateral forces causing the broom end to spread into a partial fan shape thereby resulting in the bottom end of the broom having a curved or arced shape. Since it is usually desirable for a broom bottom end to be essentially straight for best sweeping effectiveness it becomes necessary to trim the broom end to make it straight. This increases production costs and wastes broom fiber material.

To avoid cutting the broom end to make it straight the block 22 is desirably provided with a curved concave bottom 32 as shown in FIG. 3. The block 22 may also have a curved convex top 34 generally parallel to the curved bottom 36 thereby providing a block of generally uniform thickness and also desirably of uniform width with parallel vertical straight side walls. The radius of the curved bottom 32 is selected so that when all the tufts installed in holes 36 are made of fibers of the same length the fanning action of the fibers in the broom end result in the bottom end 40 being essentially straight. Thus, by reference to FIG. 3 the distance A will equal the distance B which will equal the distance C and with these distances all equaling one fiber length. This arrangement and the curved bottom of the block make it unnecessary to trim the ends of the fibers to obtain a straight ended broom, thus eliminating a manufacturing step and waste of fiber material.

The block 22 broom top includes an upwardly projecting member 50, which may be tubular in shape and have an axially positioned hole 52 which is internally threaded 54. Although the axial hole 52 may be perpendicular to block 22 when the block is essentially level it is desirable to have the axial hole 52 angled about 5° or more from vertical as shown in FIG. 3. As a result when broom handle 56, which is desirably straight, having a threaded portion 58 at its lower end, is screwed into hole 52 the handle is connected to the block 22 at a 5° slant. A pair of ribs 62, 64 are positioned on opposite sides of the upwardly projecting member 50. These ribs extend downwardly and join the top of block 22.

Although the upwardly projecting member 50 may be centrally located on block 22 it is desirable to locate it such that the broom handle axis will intersect the block top at a location, when measured from one end of the block, which is about 30 to 45% of the length of the block. This creates an unsymmetrical block in two respects, i.e., the member 50 is set off-center and is also slanted from vertical. These two features permit the broom end EZ to fit into the toe space provided at the base of kitchen cabinets and counters thus permitting easy sweeping of those obscured and often inaccessible areas.

The block 22, including the member 50 and ribs 62, 64, can be molded as a single piece from a suitable solid polymeric material, such as polypropylene.

The broom provided by the invention can include an optional broom cap which fits over the block to further improve the broom appearance.

The broom cap 70 (FIGS. 1 and 3) includes a skirt portion 72 adapted to cover the block side walls 24, 26 and end walls 28, 30 in nesting arrangement, a shoulder portion 74 closing and joined to the upper end of the skirt portion 72 and a neck portion 76 extending upwardly from the shoulder portion top and having a hole 78 at the top through which the broom handle extends. The broom cap 70 can be molded in one piece from a solid polymeric material, such as polypropylene. The skirt portion 72 can be joined to the block side walls 24, 26 and end walls 28, 30 by an adhesive or other suitable means can be used to secure the broom cap in position, including staples extending through skirt 72 into the block 22. Downward movement of the broom cap is limited by a support means which can be in the form of internal flange 82, at the top of shoulder portion 74, which contacts the top of ribs 62, 64.

The broom cap neck portion 76 can be vertical when the upwardly extending member 50 is vertical. However, when member 50 is slanted at an angle, the broom cap neck portion 76 is slanted at an appropriate angle to receive the slanted handle. The neck portion, for example, and the hole therein will be slanted at an angle of 5° when the member 50, the hole therein and the handle 56 are slanted at an angle of 5°.

Although the neck portion 76 can be centrally located on the broom cap it will, of course, be necessary to locate the neck portion off-center when the member 50 is unsymmetrically positioned on block 22. The neck portion 76 of the broom cap will generally be positioned such that the axis of the broom handle extending through the hole in the neck portion intersects the block top at a location, when measured from one end of the block, which is about 30 to 45% of the length of the block. This is particularly so when the handle is slanted about 5 to 15° from vertical.

The foregoing detailed description has been given for clearness of understanding only, and no unnecessary limitations should be understood therefrom, as modifications will be obvious to those skilled in the art.

What is claimed is:

1. A broom comprising:

an elongated block with opposing side walls and end walls, a top and, when viewed in side elevation, having a concavely curved bottom;

the block bottom having a plurality of spaced apart holes extending into the block from the block bottom;

a plurality of tufts of broom fibers, with each tuft comprising a plurality of fibers having essentially the same length, with each tuft having an upper end and a lower end and with the tufts taken as a group having fibers of essentially the same length;

the holes in the block bottom having about the same depth; each hole containing the upper end of a tuft of broom fibers embedded therein whereby a fanning effect results in which the fibers fan out from the block bottom to the lower end of the tuft;

each of the holes in the block concavely curved bottom having a direction such that the respective tufts embedded in the holes extend downwardly from the block concavely curved bottom for a substantially uniform length and the concavity of the block bottom compensates for the fanning effect of the tufts so that the lower ends of the tufts terminate in a horizontal plane and provide a straight sweeping surface, without a need to cut the lower ends of the tufts after they are embedded in the holes; and the lower end of a broom handle being connected to the block.

2. A broom according to claim 1 in which the lower end of the broom handle is connected to the block top.

3. A broom according to claim 1 in which:

the block top includes an upwardly proJecting member containing a handle-receiving hole; and the lower end of the broom handle is secured in the handle-receiving hole.

4. A broom according to claim 2 in which the broom handle is straight and is connected to the block top at an angle of at least about 5° from vertical when measured with the lower end of the broom sweeping head resting on a horizontal surface.

5. A broom according to claim 3 in which the broom handle is straight and is connected at an angle of at least about 5° from vertical when measured with the lower end of the broom sweeping head resting on a horizontal surface.

6. A broom according to claim 5 in which the handle-receiving hole in the upwardly projecting member is slanted to essentially the same angle as the handle.

7. A broom according to claim 1 in which the lower end of the broom handle is connected to the block such that the broom handle axis intersects the block top at a location, when measured from one end of the block, which is about 30 to 45% of the length of the block.

8. A broom according to claim 7 in which the lower end of the broom handle is connected to the block top.

9. A broom according to claim 7 in which:

the block top includes an upwardly projecting member containing a handle-receiving hole; and the lower end of a broom handle is secured in the handle-receiving hole.

10. A broom according to claim 7 in which:

the broom handle is straight and is connected to the block top at an angle of at least about 5° from the vertical when measured with the lower end of the broom sweeping head resting on a horizontal surface.

11. A broom according to claim 9 in which the handle-receiving hole in the upwardly projecting member is slanted to essentially the same angle as the handle.

12. A broom according to claim 11 in which:

the upwardly projecting member is tubular; and the tubular member has opposing vertical reinforcing ribs between the block side walls and extending to the block top.

13. A broom according to claim 12 in which:

the broom handle is straight and is connected to the block top at an angle of at least about 5° from the vertical when measured with the lower end of the broom sweeping head resting on a horizontal surface.

14. A broom according to claim 13 in which the angle is about 5° to 15° from the vertical.

15. A broom according to claim 1 in which the block side walls are substantially flat vertical surfaces parallel to each other.

16. A broom according to claim 1 including a broom cap which fits over the block and has an opening through which the handle extends.

17. A broom according to claim 16 in which:

the broom cap includes a skirt portion adapted to cover the block side walls and ends in nesting arrangement therewith;

a shoulder portion closing and joined to the upper end of the skirt portion; and a neck portion extending upwardly from the shoulder portion top and having a hole at the top through which the broom handle extends.

18. A broom according to claim 17 in which:

the block top includes an upwardly projecting member containing a handle-receiving hole in which the lower end of a broom handle is secured;

the upwardly projecting member has a top portion; and the broom cap shoulder portion has support means which contacts the top portion of the upwardly projecting member.

19. A broom according to claim 17 in which:

the broom handle is straight and is connected to the block top at an angle of at least about 5° from vertical when measured with the lower end of the broom sweeping head resting on a horizontal surface; and the broom cap neck portion is slanted at an angle adapted to receive the slanted handle.

20. A broom according to claim 17 in which:

the neck portion of the broom cap is positioned such that the axis of the broom handle extending through the hole in the neck portion intersects the block top at a location, when measured from one end of the block, which is about 30 to 45% of the length of the block.

21. A broom according to claim 20 in which:

the broom handle is straight and is connected to the block top at an angle of at least about 5° from vertical when measured with the lower end of the broom sweeping head resting on a horizontal surface.

22. A broom according to claim 21 in which:

the block top includes an upwardly projecting member containing a handle-receiving hole and the lower end of the broom handle is secured in the handle-receiving hole;

the upwardly projecting member and hole therein are slanted to essentially the same angle as the handle; and the broom cap neck portion is slanted to essentially the same angle as the handle.

* * * * *